US008319592B2

(12) United States Patent
Kawarai

(10) Patent No.: US 8,319,592 B2
(45) Date of Patent: Nov. 27, 2012

(54) VARIABLE INDUCTOR

(75) Inventor: Mitsugu Kawarai, Chuo-ku (JP)

(73) Assignee: Sumida Corporation (JP)

( * ) Notice: Subject to any disclaimer, the term of this patent is extended or adjusted under 35 U.S.C. 154(b) by 0 days.

(21) Appl. No.: 13/154,099

(22) Filed: Jun. 6, 2011

(65) Prior Publication Data

US 2011/0234354 A1 Sep. 29, 2011

Related U.S. Application Data

(63) Continuation of application No. PCT/JP2009/065563, filed on Sep. 7, 2009.

(30) Foreign Application Priority Data

Dec. 8, 2008 (JP) ..... 2008-312547

(51) Int. Cl.
*H01F 21/06* (2006.01)

(52) U.S. Cl. ..... 336/134

(58) Field of Classification Search ..... 336/130–134
See application file for complete search history.

(56) References Cited

U.S. PATENT DOCUMENTS

| | | | | |
|---|---|---|---|---|
| 3,686,464 | A * | 8/1972 | Hirst | 219/130.1 |
| 3,716,719 | A * | 2/1973 | Angelery et al. | 307/17 |
| 4,031,496 | A * | 6/1977 | Fujiwara et al. | 336/135 |
| 4,149,133 | A * | 4/1979 | Hilgert | 336/30 |
| 4,837,497 | A * | 6/1989 | Leibovich | 323/345 |
| 5,061,896 | A * | 10/1991 | Schmidt | 324/207.18 |
| 7,138,898 | B2 | 11/2006 | Ishikawa | |
| 2003/0084860 | A1 * | 5/2003 | Haghgooie et al. | 123/90.11 |

FOREIGN PATENT DOCUMENTS

| | | |
|---|---|---|
| JP | 48-105016 | 12/1973 |
| JP | 59-178713 | 10/1984 |
| JP | 63-067710 | 3/1988 |
| JP | 03-166706 | 7/1991 |
| JP | 2005-064263 | 3/2005 |
| JP | 2005-064308 | 3/2005 |
| JP | 2006-286805 | 10/2006 |

* cited by examiner

*Primary Examiner* — Tuyen Nguyen
(74) *Attorney, Agent, or Firm* — Harness, Dickey & Pierce, P.L.C.

(57) ABSTRACT

A variable inductor includes: a first coil; a second coil which emanates a magnetic flux in a cancelling direction with respect to the magnetic flux generated in the first coil; a plate-shaped movable core positioned between the first coil and the second coil for carrying out opening & closing operation; and first and second magnetic cores, having a closed magnetic-path structure which involves the first coil, the second coil and the movable core. The first magnetic core includes a first center-core portion around which the first coil is wound and the second magnetic core includes a second center-core portion around which the second coil is wound.

12 Claims, 9 Drawing Sheets

30
A
A'
B
B'
35
1
2
3a
3b
5
6
7
8
21
31
32
33
34

VARIABLE INDUCTOR

CROSS-REFERENCE TO RELATED APPLICATIONS

This application is a continuation of PCT/JP2009/065563 filed Sep. 7, 2009, which claims priority to Japanese Application No. 2008-312547 filed Dec. 8, 2008, both of which are hereby incorporated by reference in their entirety.

TECHNICAL FIELD

The present invention relate to a variable inductor which is suitable for being applied in a case, for example, in which an inductance value of a coil used in electronic equipment is to be changed.

BACKGROUND ART

In the past, there has been a variable inductor in which a position of a magnetic core with respect to a coil is changed by an external signal such that the inductance value of the coil can be changed. Such a variable inductor is used, for example, for adjustment of filter characteristic and resonance frequency in an LC filter and a resonance circuit.

In Japanese patent publication No, 2005-64308, it is disclosed with respect to a variable inductor in which magnetic flux is changed by moving a magnetic flux changeable means in the vicinity of an inductor and the inductance value is changed thereby.

In Japanese patent publication No. 2006-286805, it is disclosed with respect to a variable inductor in which the inductance thereof is changed by changing the frequency of alternate current to be applied.

DISCLOSURE OF THE INVENTION

Meanwhile, with respect to the variable inductor in the past, the adjustment range of the inductance value was narrow. For example, with respect to the variable inductor disclosed in Japanese patent publication No. 2005-64308, it was possible to realize a change amount of inductance only around 10% to 30%.

For the equipment in which the variable inductor in the past was used, it was possible to use the variable inductor sufficiently even if the adjustment range thereof was narrow, so that there was a restriction in the variable range of the inductance, which was required for the variable inductor. Conversely, owing to a fact that the variable range of the variable inductor in the past was narrow, it can be said that use application of the variable inductor was restricted to the equipment mentioned above. Consequently, if the adjustment range of the inductance of the variable inductor becomes drastically wide, it is obvious that the use application thereof will expand drastically and industrial usability will increase.

However, even if the variable range of the inductance value is wide, when an open magnetic path structure is employed, magnetic fields are emitted from the inductor and unnecessary electromagnetic waves are radiated. Such electromagnetic waves become a cause of EMI (EMI: Electro Magnetic Interference). Consequently, in a case in which a plurality of electronic equipment exists mixedly on the periphery of the variable inductor, it sometimes happens, caused by interfering electromagnetic waves, that there is received a bad influence of decrease in function, mis-operation, stoppage, disappearance of record and the like of electronic equipment existing in the vicinity of the variable inductor. In particularly, in a power supply circuit handling a large electric current, it is not possible to use the variable inductor of the past. For example, with respect to the variable inductor disclosed in Japanese patent publication No. 2006-286805, the leakage magnetic flux thereof becomes a lot and it easily exerts influence on the outside electronic equipment, so that practicality thereof is poor. Consequently, it was necessary to take a countermeasure from a view point of electromagnetic compatibility.

The present invention was invented in view of such a situation and is addressed to change the inductance value while suppressing occurrence of interfering electromagnetic waves.

A variable inductor relating to the present invention includes: a first coil; a second coil which emanates a magnetic flux toward the direction cancelling the magnetic flux emanated by the first coil; a movable core for blocking the magnetic flux emanated by the first coil and the second coil by being moved between the first coil and the second coil; and a magnetic core having a closed magnetic-path structure which involves the first coil, the second coil and the movable core.

By doing in this manner, the first coil, the second coil and the movable core are involved owing to the magnetic core of the closed magnetic-path structure, so that it is possible to decrease leakage magnetic flux toward the outside and it is possible to make the changing range of the inductance value larger on a situation of suppressing occurrence of interfering electromagnetic waves.

According to the present invention, the first coil, the second coil and the movable core are involved owing to the magnetic core of the closed magnetic-path structure, so that it is possible to decrease leakage magnetic flux toward the outside and it is possible to suppress occurrence of interfering electromagnetic waves. Then, there is an effect that it is possible to carry out the adjustment of the inductance value easily by moving the movable core.

BEST MODE FOR CARRYING OUT THE INVENTION

Hereinafter, it will be explained with respect to a first exemplified embodiment of the present invention with reference to FIG. 1 to FIG. 5. In this exemplified embodiment, it will be explained, for example, with respect to an example applied to a variable inductor 10 which is employed in small sized electronic equipment and electronic circuit.

Figure 1A:
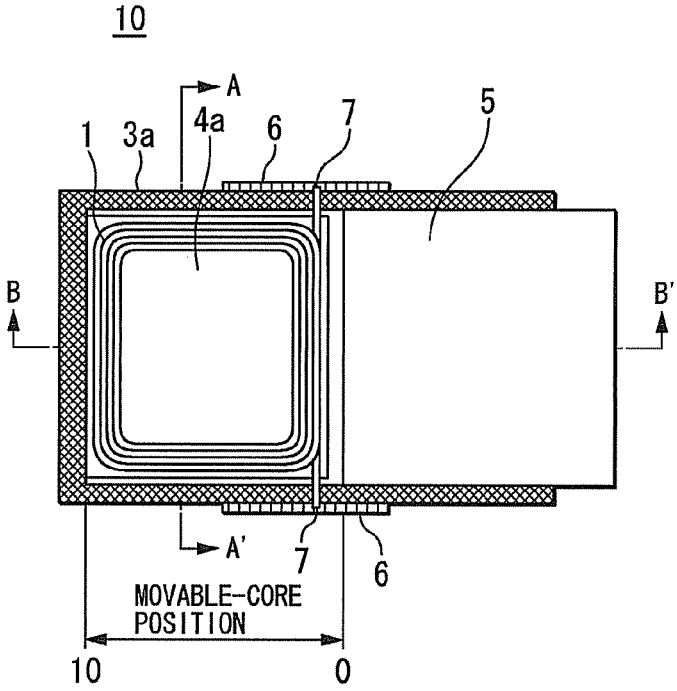
FIGS. 1A, 1B and 1C are constitution diagrams showing an example of a variable inductor in a first exemplified embodiment of the present invention.
Figure 1B:
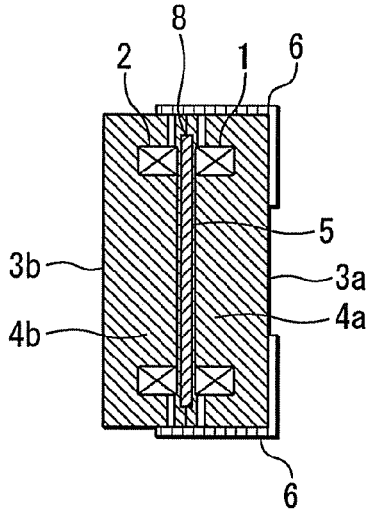
Figure 1C:
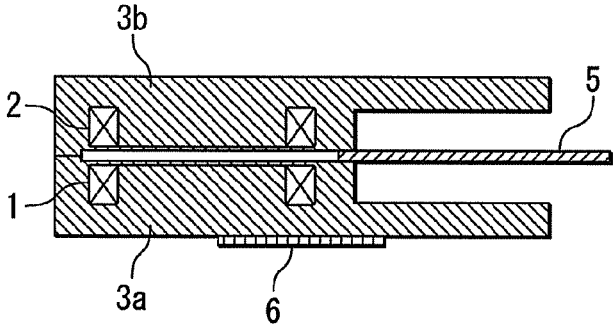

FIGS. 1A, 1B and 1C show a constitution example of the variable inductor 10.

FIG. 1A shows a constitution example of the variable inductor 10 in case of being plan-viewed.

FIG. 1B shows an example of a cross-section diagram along an A-A' line of the variable inductor 10 in FIG. 1A.

FIG. 1C shows an example of a cross-section diagram along a B-B' line of the variable inductor 10 in FIG. 1A.

The variable inductor 10 includes magnetic-core center-core portions 4*a*, 4*b*; and a first coil 1 and a second coil 2 which are formed by a constitution in which the conduction wires thereof are wound-around on the peripheries of the magnetic-core center-core portions 4*a*, 4*b*. The first coil 1 and the magnetic-core center-core portion 4*a* are covered for their periphery by a box-shaped magnetic core 3*a* which is formed with an opening portion for one surface thereof and a plate-shaped movable core covering this opening portion. On the side surfaces of the magnetic core 3*a*, there are provided external electrodes 6 to which coil end-portion pulled-out portions 7 extended from the first coil 1 and the second coil 2 are connected. The coil end-portion pulled-out portions 7 are end portions of the first coil 1 and the second coil 2, which are extended from the walls of the magnetic core 3*a* and which are connected to the external electrodes 6, and by a fact that the coil end-portion pulled-out portions 7 are connected to the external electrodes 6, the first coil 1 and the second coil 2 are to be connected in parallel.

The first coil 1 is a coil whose electric conductive wire is wound around with an air core. Generally, the electric conductive wire is formed by coating an insulation film circumferentially on a copper core. However, in order to form the variable inductor 10 in a low height shape, it is allowed for the first coil 1 to use a flat coil formed on an insulation resin sheet other than winding wires. However, in case of using a flat coil, an insulation process between the winding wires becomes necessary. Consequently, for example, it is enough if the coil is to be formed so as to be covered by resin or the coil is to be covered by a mixture of resin and magnetic powder in order to heighten the magnetic permeability thereof.

The second coil 2 is a coil formed by an identical material, an identical turn number and an identical winding method as those of the first coil 1. However, the second coil 2 is connected in parallel with the first coil 1, so that the winding wire of the second coil 2 is wound-around in a reverse direction with respect to the winding wire of the first coil 1. Thus, it is possible to cancel the magnetic flux emanated from the first coil 1.

The magnetic core having a closed magnetic-path structure, which involves the first coil 1, the second coil 2 and the movable core 5 is formed by combining the magnetic core 3*a* provided with the first coil 1 and a second magnetic core provided with the second coil 2. The magnetic core 3*a* includes the magnetic-core center-core portion 4*a* around which the first coil 1 is wound and the second magnetic core 3*b* includes the magnetic-core center-core portion 4*b* around which the second coil 2 is wound. The magnetic core 3*a* and magnetic-core center-core portion 4*a*, and also, the magnetic core 3*b* and magnetic-core center-core portion 4*b* are cores formed by being sintered from ferrite or formed by using a material such as a metal-based magnetic material and the like. The magnetic core 3*a* and magnetic-core center-core portion 4*a*, and also, the magnetic core 3*b* and magnetic-core center-core portion 4*b* have a property that the magnetic flux can pass easily while keeping high magnetic permeability. Then, the magnetic core 3*a* and magnetic core 3*b* are a portion of the magnetic body core surrounding the whole of the first coil 1 and the second coil 2, and there is included a function of repressing the leakage magnetic flux.

The movable core 5 is a flat plate-shaped magnetic body core formed by being sintered from ferrite or formed by using a material such as a metal-based magnetic material and the like. The movable core 5 has a property that the magnetic flux can pass easily while keeping high magnetic permeability. The facing two sides of the movable core 5 are supported by guide grooves 8 formed inside the surfaces of the magnetic core 3*a* in the moving direction of the movable core and the movable core 5 is movable laterally along the guide grooves 8. Then, the movable core 5 is coupled to an actuator which is not shown and which controls the opening & closing operation of the movable core 5. It is allowed for the actuator to be installed at an empty-space occurring on the outside of the magnetic cores 3*a* and 5 and it is also allowed to be installed at another place on the outside of the variable inductor 10 of the present invention.

The guide grooves 8 have a function for holding the movable core 5 and for allowing a free movement of the movable core 5. In order to move the movable core 5 more smoothly, it is allowed for the guide grooves 8 to form approximately L-shape grooves on the walls of the magnetic cores 3*a*, 3*b* and to make rail surfaces by coating resin on the inside surfaces of the L-shape grooves. Also, in response to the manufacturing process or the use requirement, it is also possible to add and/or to change the most suitable constitution properly. For example, on the outside of the variable inductor 10, it is allowed to form a support member and/or a rail surface of the movable core 5 by inserting a filling member made of resin at an empty-space portion between the magnetic cores 3*a*, 3*b* and it is also allowed to arrange and locate an actuator for driving the movable core 5 by making a vacant space on one side thereof.

The external electrodes 6 are connected to both the ends of the first coil 1 and the second coil 2 which are connected in parallel, and externally supply electric current to the first coil 1 and the second coil 2. The external electrodes 6 are formed from the coil end-portion pulled-out portions 7 to the mounting portion of the substrate which is not-shown and with which the outside of the magnetic core 3*a* and the magnetic core 3*a* contact by, for example, coating and baking a mixture of a metallic powder of silver or the like and a resin. For the variable inductor 10, there are used only two external electrodes 6, so that it is possible to save the material and the space. It should be noted that it is allowed to adhere metal made electrodes on the magnetic core 3*a* as the external electrodes 6 and then, to solder the coil end portions of the first coil 1 and the second coil 2 on these electrodes.

Figure 2:
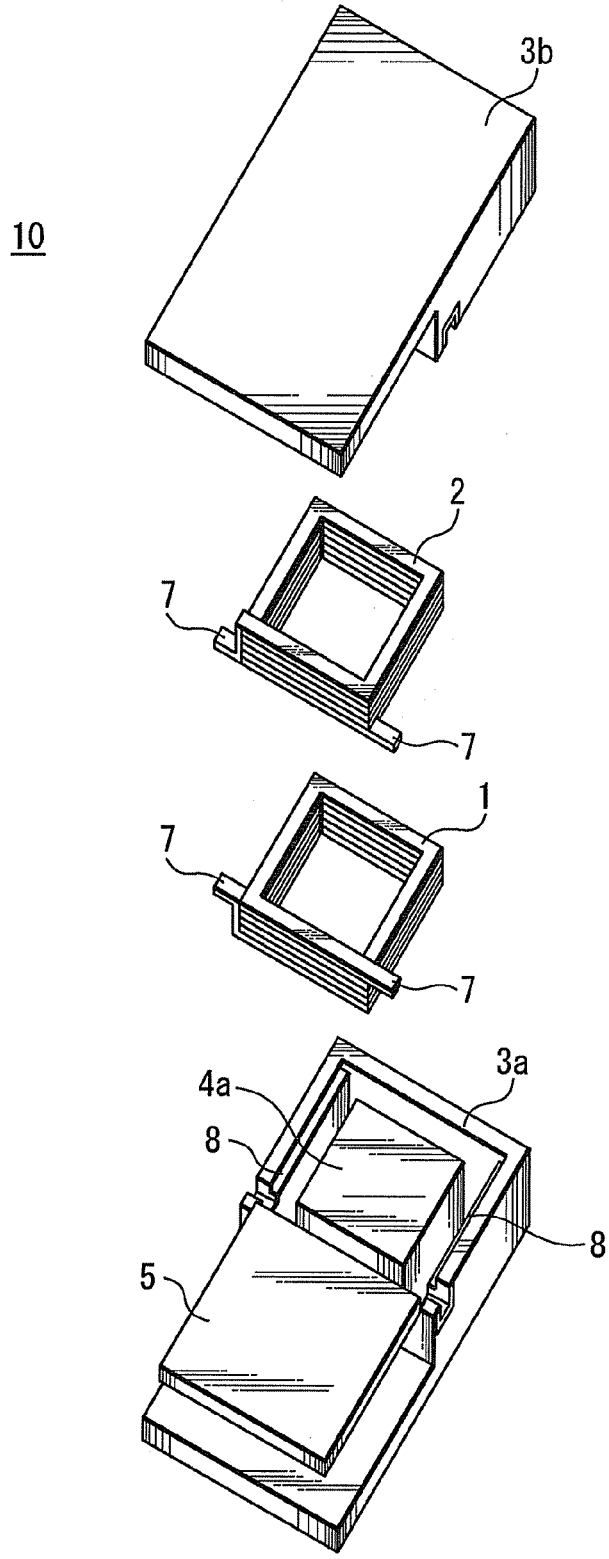
FIG. 2 is an exploded perspective view showing an example of a variable inductor in the first exemplified embodiment of the present invention.

FIG. 2 is an exploded perspective view of the variable inductor 10.

In FIG. 2, illustrations with respect to the external electrodes 6 and the support member of the movable core 5 are omitted. It is shown by FIG. 2 that the first coil 1 is installed by being fitted with the magnetic-core center-core portion 4*a* which is provided in the magnetic core 3*a* and the second coil 2 is installed by being fitted with the magnetic-core center-core portion 4*b* (see FIG. 1) which is provided in the magnetic core 3*b*. Also, it is shown that the movable core 5 is movable along the guide grooves 8.

Figure 3:
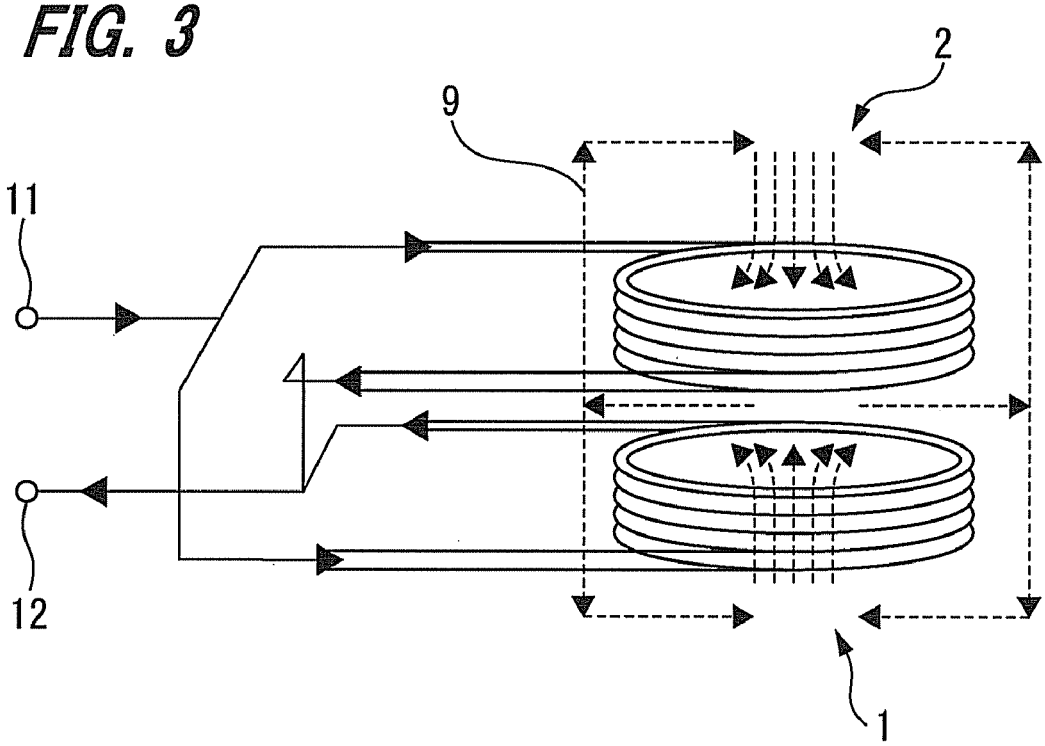
FIG. 3 is an explanatory diagram showing an example of a first connection method of coils in the first exemplified embodiment of the present invention.

FIG. 3 shows an example of a first connection method of the coils.

The first coil 1 and the second coil 2 which the variable inductor 10 includes are connected in parallel. With respect to the first coil 1 and the second coil 2, the winding wire methods are identical and places at which the winding axis of the first coil 1 and the winding axis of the second coil 2 coincide with each other (in this embodiment, axes of air cores), that is, the axes of these air cores are arranged in the same direction. Arrows on the conduction wires show directions of electric currents and by the electric currents which are inputted from the unit 11 and outputted from the unit 12, the first coil 1 and the second coil 2 generate the magnetic fluxes. Here, with respect to the magnetic fluxes which the first coil 1 and the second coil 2 emanate, the densities thereof are identical each other, but the directions thereof become opposite each other. Consequently, the magnetic fluxes occurring inside the first coil 1 and the second coil 2 are almost canceled. However, a few leakage magnetic fluxes 9 will leak out to the outside from between the first coil 1 and the second coil 2, but they are not such strong magnetic fluxes as to cause interfering electromagnetic waves.

Figure 4:
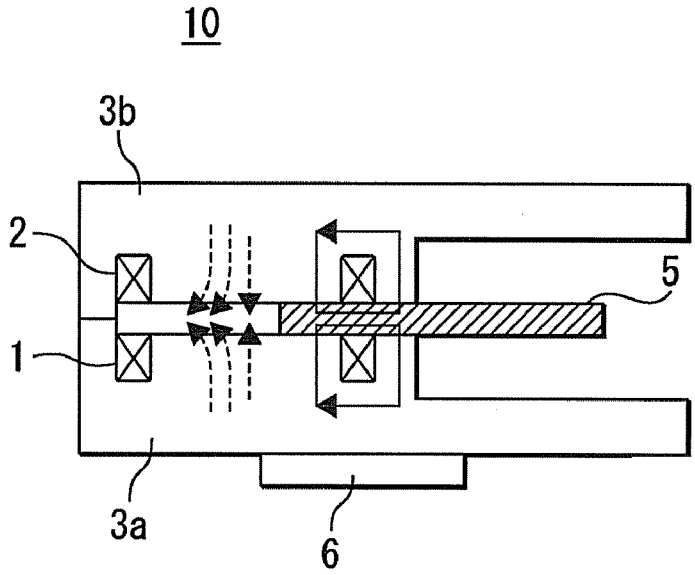
FIG. 4 is an explanatory diagram showing an example in which the direction of the magnetic flux occurring at the variable inductor in the first exemplified embodiment of the present invention is modelized.

FIG. 4 shows an example of a cross-section diagram along a B-B' line of the variable inductor 10 in FIG. 1A.

Here, it will be explained with respect to an example in which the direction of the magnetic flux occurring at the variable inductor 10 is modelized.

The first coil 1 and the second coil 2 are housed in the magnetic cores 3*a*, 3*b* and further, the movable core 5 is inserted between the first coil 1 and the second coil 2. At that time, the movable core 5 moves toward the vertical direction with respect to the winding axis direction of the first coil 1 and second coil 2. Thus, at a portion at which the first coil 1 and the second coil 2 are blocked by the movable core 5, the magnetic fluxes of opposite directions, which the first coil 1 and the second coil 2 emanate are joined together by the movable core 5. Consequently, the movable core 5 and the magnetic cores 3*a*, 3*b* constitute a closed magnetic-path. Also, at a portion at which the magnetic fluxes of the opposite directions, which the first coil 1 and the second coil 2 emanate are joined, an inductance occurs. On the other hand, at a portion which is not blocked by the movable core 5, as mentioned above, the upward and downward magnetic fluxes (magnetic fluxes shown by broken lines in FIG. 3) are cancelled each other and do not contribute to the inductance. Consequently, owing to a fact that the amount of magnetic flux which contributes to the inductance is adjusted by changing the insertion degree of the movable core 5, it becomes possible to adjust the inductance value.

Next, it will be explained with respect to an example of a process for producing the variable inductor 10 with reference to FIG. 5.

Figure 5:
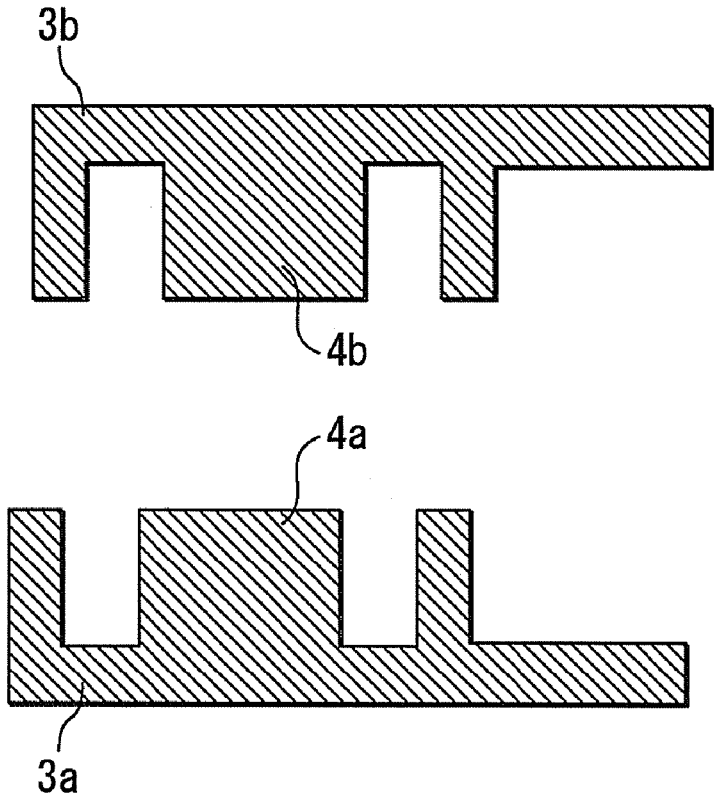
FIG. 5 is an explanatory diagram showing an example of a cross-section diagram of a magnetic core along a B-B' line of the variable inductor in FIG. 1A according to the first exemplified embodiment of the present invention.

FIG. 5 shows an example of a cross-section diagram of the magnetic cores 3*a*, 3*b* along a B-B' line of the variable inductor 10 in FIG. 1A.

First, the magnetic cores 3*a*, 3*b* and the magnetic-core center-core portion 4*a* are formed. The magnetic cores 3*a*, 3*b* and the magnetic-core center-core portion 4*a* are formed in desired shapes by pressing a raw material powder, that is, for example, a soft magnetic ferrite powder of Ni—Zn based ferrite or the like and thereafter, by being sintered and solidified as a sintered body in a furnace, there are formed the magnetic cores 3*a*, 3*b* which are made to be symmetrical upward and downward. At the same time, there are formed the first coil 1 and the second coil 2, which have air cores.

Next, after attaching the first coil 1 and the second coil 2 on the magnetic cores 3*a*, 3*b* respectively, the plate-shaped movable core 5 and the actuator which is not shown are attached thereto.

Next, the coil end-portion pulled-out portions 7 are extended from the walls of the magnetic cores 3*a*, 3*b*.

Finally, the magnetic cores 3*a*, 3*b* are mated together and bonded and fixed by an adhesive agent or the like and the external electrodes 6 are formed outside the magnetic cores 3*a*, 3*b*.

According to the variable inductor 10 relating to the first exemplified embodiment explained above, it becomes possible to widen the variable range of the inductance by setting from a state of forming a complete closed magnetic-path by means of the magnetic body to a state of an open magnetic path and further, to a state of an air core coil by moving the magnetic body away from the coil. Also, the magnetic fluxes emanated from the first coil 1 and the second coil 2 are set to be in correctly reverse directions, so that it is possible to cancel magnetic fluxes each other. Further, the first coil 1 and the second coil 2 are involved in the magnetic cores 3*a*, 3*b* and it becomes in a closed magnetic-path structure through the magnetic cores 3*a*, 3*b* and the magnetic-core center-core portion 4*a*. Consequently, there is an effect in which it becomes difficult for the leakage magnetic flux to occur on the outside of the variable inductor 10.

Also, with respect to the movable core 5, the opening & closing operation is carried out by the actuator which is not shown so as to be inserted between or away from the first coil 1 and the second coil 2. At that time, an inductance occurs by the magnetic fluxes which do not cancel each other within the magnetic fluxes emanated by the first coil 1 and the second coil 2. Consequently, there is an effect that the variable range of the inductance of the inductor 10 becomes wider than that of a general variable inductor.

Also, owing to a constitution that the movable core 5 blocks the magnetic fluxes emanated by the first coil 1 and the second coil 2, it is possible to adjust the inductance easily. In addition, in order to adjust the amount of movement of the movable core 5, it is allowed to provide an adjusting unit for adjusting the position with respect to the first coil 1 and the second coil 2 of the movable core 5 on either one of or both of the magnetic cores 3*a*, 3*b*. For example, if an actuator which is not shown is used as the adjusting unit, the movable core 5 can be moved by a very small force along the guide grooves 8 by the actuator. Consequently, it is possible to fine-adjust the inductance to a desired value.

It should be noted that the process for producing the variable inductor 10 is not limited by the process explained in the first exemplified embodiment mentioned above. It is also possible to employ various kinds of manufacturing processes, manufacturing orders or modifications without departing from the gist of the present invention.

Figure 6:
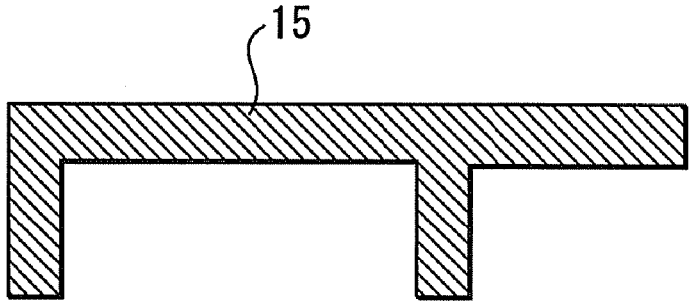
FIG. 6 is an explanatory diagram showing an example of a cross-section diagram of a magnetic core along a B-B' line of the variable inductor in FIG. 1A according to another exemplified embodiment of the present invention.

FIG. 6 shows a modification example of the magnetic cores 3*a*, 3*b*.

Instead of the magnetic cores 3*a*, 3*b* relating to the first exemplified embodiment mentioned above, it is allowed to sinter a magnetic core 15 whose cross-section shape is shown as FIG. 6 and then to insert a coil wound on an I type core into the inside of the magnetic core 15.

Also, in order to position-fix the magnetic cores 3*a*, 3*b*, and the first coil 1 and the second coil 2, it is allowed to employ a process for bonding both the sides thereof by a resin or the like. Also, after the first coil 1 and the second coil 2 are inserted into the magnetic cores 3*a*, 3*b*, it is allowed to employ a sintering process by putting-in a mixture of a resin and a ferrite powder so as to coat the coil. Also, it is allowed to add a support member for supporting the movable core 5 in an empty-space between the magnetic cores 3*a*, 3*b* and the movable core 5 or it is also allowed to add a filling agent of a resin or the like therein.

Also, it is allowed to add a mixture of a powder magnetic body and a resin in an empty-space among the magnetic cores 3*a*, 3*b* and the first coil 1 and the second coil 2 so as not to leak out the magnetic flux from an empty-space of the magnetic cores 3*a*, 3*b*. Also, with respect to the formation method of the magnetic cores 3*a*, 3*b*, the dry method mentioned above was disclosed, but in case of requiring a core having higher quality, it is possible to use also a wet method. Also, it is allowed for the shape of the magnetic cores 3*a*, 3*b* to employ not only a hexahedron shape but also a cylinder shape or a polyhedron shape.

Next, it will be explained with respect to a second exemplified embodiment of the present invention with reference to FIG. 7 and FIG. 8.

Also in this exemplified embodiment, it will be explained with respect to an example being applied to a variable inductor which is employed, for example, in small-sized electronic equipment or electronic circuit. In the following explanation, the same reference numerals are put on the portions corresponding to those in FIG. 1, which were already explained in the first exemplified embodiment and the detailed explanations thereof will be omitted.

Figure 7A:
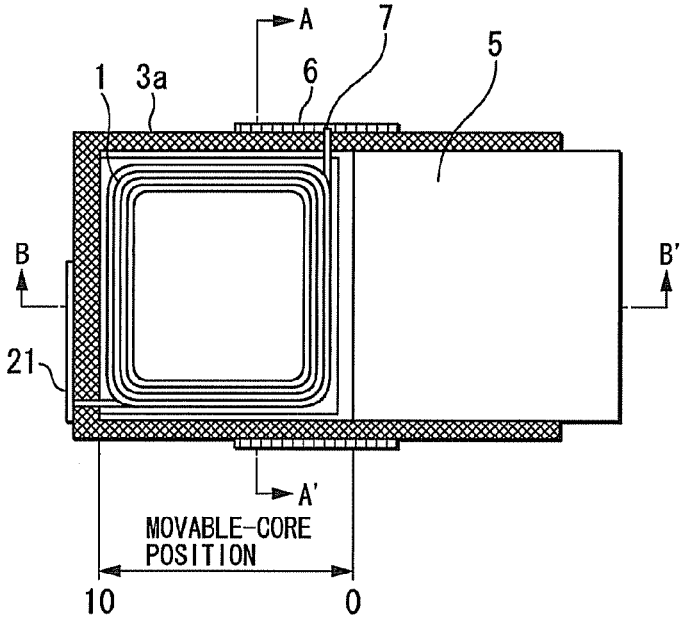
FIGS. 7A, 7B and 7C are constitution diagrams showing an example of a variable inductor in a second exemplified embodiment of the present invention.
Figure 7B:
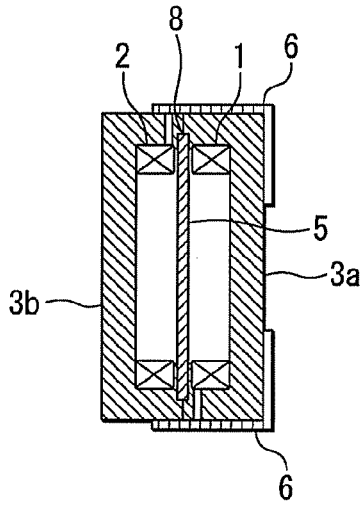
Figure 7C:
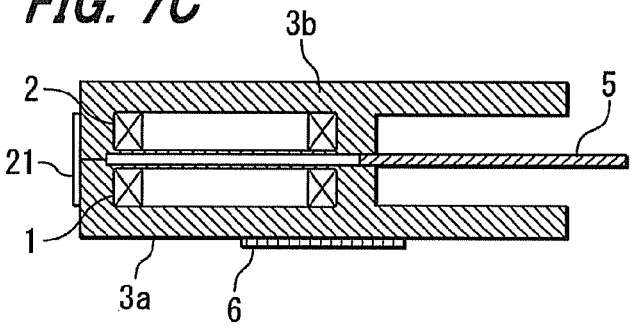

FIGS. 7A, 7B and 7C show a constitution example of the variable inductor 20.

FIG. 7A shows a constitution example of the variable inductor 20 in case of being plan-viewed.

FIG. 7B shows an example of a cross-section diagram along an A-A' line of the variable inductor 20 in FIG. 7A.

FIG. 7C shows an example of a cross-section diagram along a B-B' line of the variable inductor 20 in FIG. 7A.

A constitution of the variable inductor 20 is approximately identical with the constitution of the variable inductor 10 relating to the first exemplified embodiment mentioned above. However, with respect to the variable inductor 20, there are different in an aspect in which the first coil 1 and the second coil 2 are connected in series and in an aspect in which the magnetic-core center-core portions 4*a*, 4*b* are not included. Consequently, the magnetic core of the closed magnetic-path structure which involves the first coil 1, the second coil 2 and the movable core 5 is only formed by combining the first magnetic core 3*a* including the first coil 1 and the second magnetic core 3*b* including the second coil 2.

In order to generate magnetic fluxes from the first coil 1 and the second coil 2 in directions facing each other, the winding directions of the conduction wires on both sides are made to be the same. Then, on the variable inductor 20, there is installed a connection electrode 21 by which the first coil 1 and the second coil 2 are connected in series. The connection electrode 21 is installed on the side surfaces of the magnetic cores 3*a*, 3*b*, so that there are formed cutout portions on the side surfaces of the magnetic cores 3*a*, 3*b* corresponding to the connection electrode 21.

Figure 8:
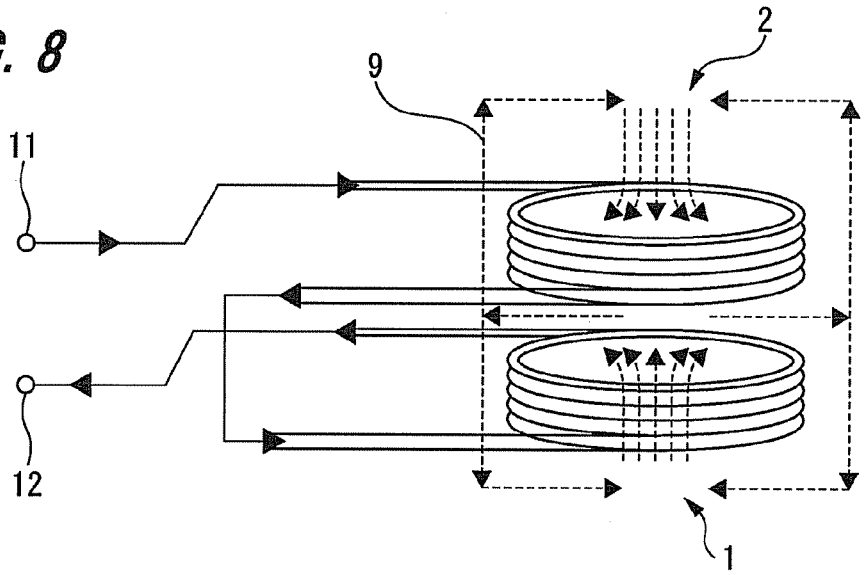
FIG. 8 is an explanatory diagram showing an example of a second connection method of coils in the second exemplified embodiment of the present invention.

FIG. 8 shows an example of a second connection method of the coils.

The first coil 1 and the second coil 2 which the variable inductor 20 includes are connected in series. With respect to the first coil 1 and the second coil 2, the winding wire methods are identical and the axes of the air cores are arranged in the same direction. By the electric currents which are inputted from the unit 11 and outputted from the unit 12, the first coil 1 and the second coil 2 generate the magnetic fluxes. With respect to the magnetic fluxes which the first coil 1 and the second coil 2 emanate, the densities thereof are identical each other and the directions thereof become identical.

With respect to the variable inductor 20 relating to this exemplified embodiment, there was cited an example which does not include the magnetic-core center-core portions 4*a*, 4*b* and this reason is for improving superimposing characteristic of the variable inductor. Generally, in a power supply device in particular, when flowing a surge electric current in a coil, magnetic flux density passing through the magnetic core which is wound around the coil becomes high and a phenomenon referred to as "magnetic saturation" occurs. Caused by this phenomenon, even though the electric current becomes large, there occurs such a problem that the inductance is to be lowered. It should be noted that there is an index referred to as "direct current superimposing characteristic" which represents a relation between the electric current and the inductance value. In the second exemplified embodiment, according to an intention of improving the direct current superimposing characteristic, it is devised so as not to cause magnetic saturation by eliminating the magnetic-core center-core portions 4*a*, 4*b*. It should be noted that in response to the actual requirement, it is allowed to employ a constitution in which the magnetic-core center-core portions 4*a*, 4*b* are added therein.

Here, it will be explained with respect to comparison examples of the variable ranges of the inductance values of the variable inductors 10, 20 with reference to FIG. 9 to FIG. 11. In order to carry out this comparison, a comparison sample is produced by using technologies in the past and the variable ranges of the inductance values of the comparison sample and the variable inductors 10, 20 are compared.

Figure 9A:
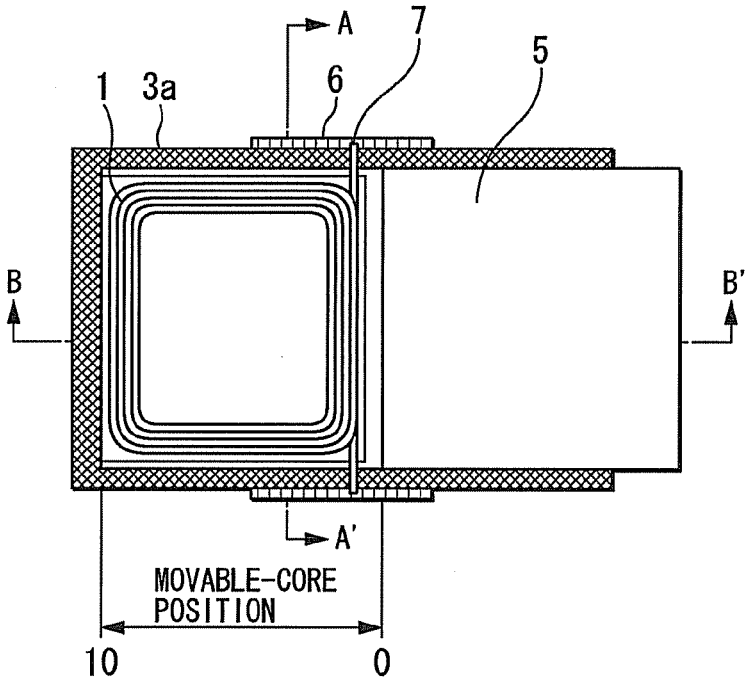
FIGS. 9A, 9B and 9C are constitution diagrams showing an example of a comparison sample.
Figure 9B:
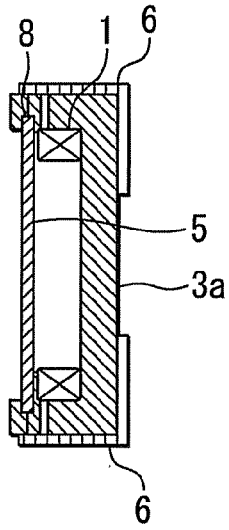
Figure 9C:
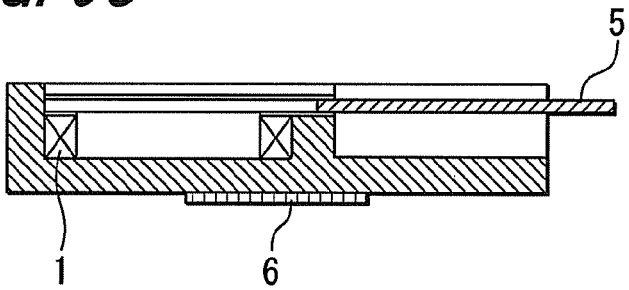

FIGS. 9A, 9B and 9C show a constitution example of the comparison sample.

FIG. 9A shows a constitution example of the comparison sample in case of being plan-viewed.

FIG. 9B shows an example of a cross-section diagram along an A-A' line of the comparison sample in FIG. 9A.

FIG. 9C shows an example of a cross-section diagram along a B-B' line of the comparison sample in FIG. 9A.

The structure of the comparison sample is approximately identical with the structure of the variable inductor 20. However, the comparison sample is made to be in a state in which the second coil 2 and the magnetic core 3*b* of the upper portion are removed. Consequently, the comparison sample becomes in an open magnetic path structure.

Figure 10:
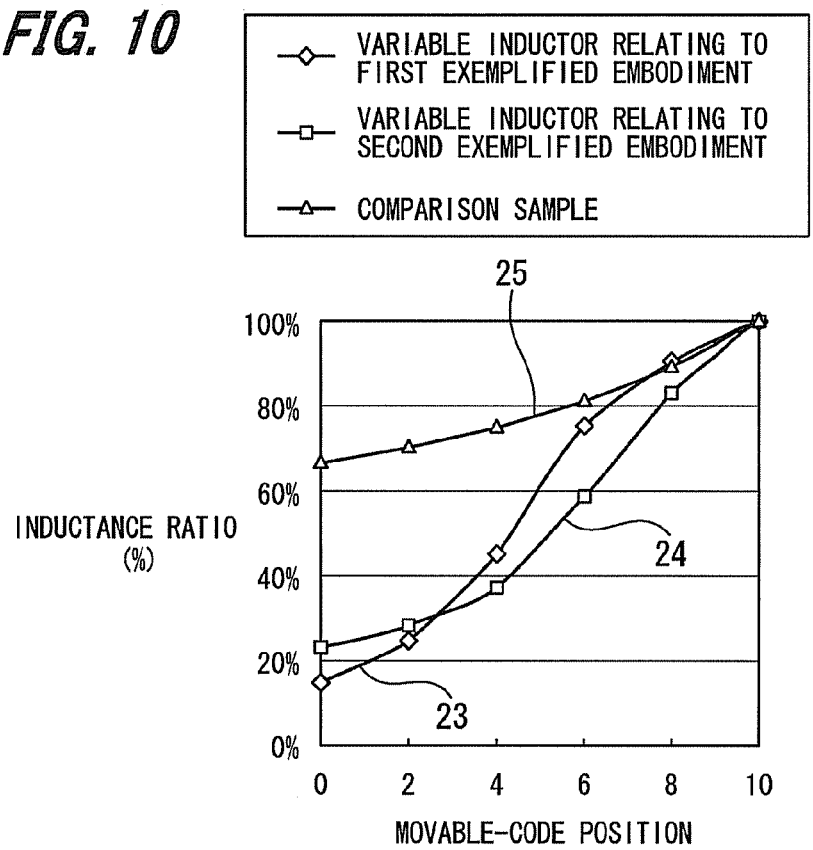
FIG. 10 is an explanatory diagram showing an example of inductance ratios with respect to movable-core positions of the variable inductors in the first and second exemplified embodiment and in the comparison sample.

FIG. 10 indicates an example of the change ratios of the inductance values of the variable inductors 10, 20 and the comparison sample in case of changing the positions of the movable cores 5. In FIG. 10, according to a sequential line 23 showing the inductance ratio of the variable inductor 10, a sequential line 24 showing the inductance ratio of the variable inductor 20 and a sequential line 25 showing the inductance ratio of the comparison sample, there are indicated the inductance ratios with respect to the positions of the movable cores 5.

Also, the position in a case in which the movable core 5 blocks the first coil 1 and the second coil 2 completely is assumed to be "10" and the position in a case in which the movable core 5 is pulled out completely from the first coil 1 and the second coil 2 is assumed to be "0" (see FIG. 1A, FIG. 7A and FIG. 9A). Hereinafter, the relative position of the movable core 5 with respect to the position "0" is referred to as "movable-core position". Then, assuming that the inductance value is "1" on an occasion when the movable core 5 is at the "10" position, the inductance values at other positions are normalized accordingly.

As shown in FIG. 10, it is understood that while the inductance ratios of the variable inductors 10, 20 when the movable-core position is "0" are both in a vicinity of 20%, the inductance ratio of the comparison sample is in a vicinity of 70%. Consequently, it can be said with respect to the inductance ratios of the variable inductors 10, 20 that the change ratios thereof are large compared with that of the inductance ratio of the comparison sample.

Figure 11:
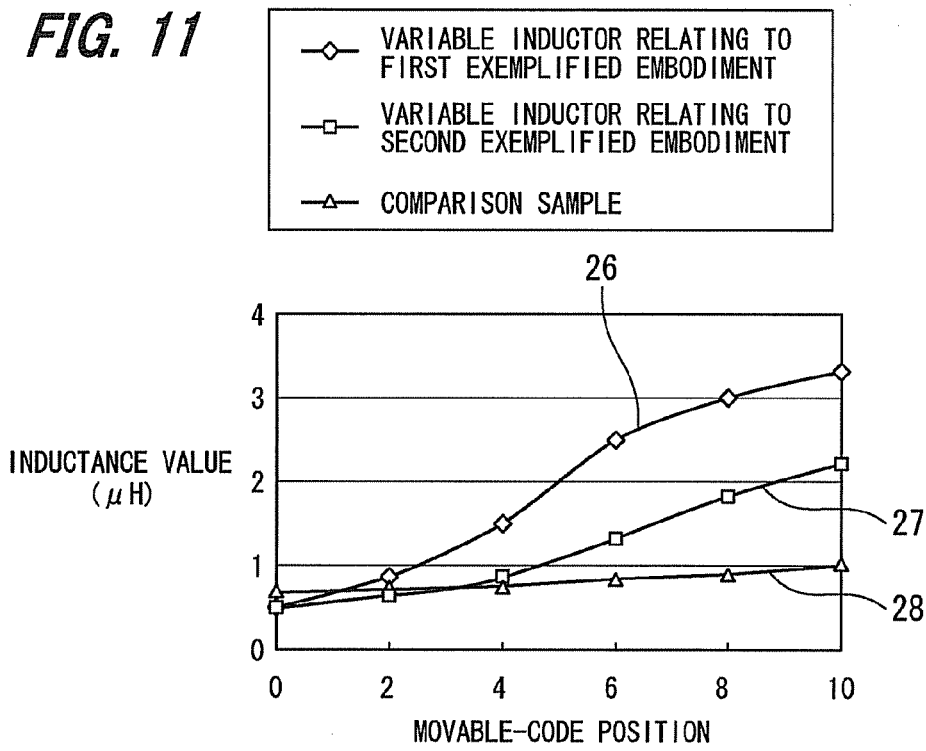
FIG. 11 is an explanatory diagram showing an example of inductance values with respect to movable-core positions of the variable inductors in the first and second exemplified embodiment and in the comparison sample.

FIG. 11 shows an example of the relations between specific inductance values and the positions.

FIG. 11 indicates an example of the inductance values of the variable inductors 10, 20 and the comparison sample in case of changing the positions of the movable cores 5. In FIG. 11, according to a sequential line 26 showing the inductance value of the variable inductor 10, a sequential line 27 showing the inductance value of the variable inductor 20 and a sequential line 28 showing the inductance value of the comparison sample, there are indicated the inductance values with respect to the positions of the movable cores 5.

As shown in FIG. 11, when the movable-core position is "10", the inductance value of the variable inductor 10 is approximately 3.3 μH and the inductance value of the variable inductor 20 is approximately 2.2 μH. On the other hand, it is understood that the inductance value of the comparison sample is approximately 1.0 μH. Consequently, it can be said with respect to the inductance values of the variable inductors 10, 20 that the change rates thereof are large compared with that of the inductance value of the comparison sample.

With respect to the inductance values of the variable inductors 10, 20, in a state in which the movable core 5 is inserted and the first coil 1 and the second coil 2 are blocked, the first coil 1 and the second coil 2 respectively form magnetic paths independently, so that the interaction of the generated magnetic fluxes becomes very small. On one hand, the first coil 1 and the second coil 2 function as independent two inductors, so that the inductance value is obtained as a case in which the two inductors are connected in series or in parallel. On the other hand, in a state in which the movable core 5 is pulled out from the first coil 1 and the second coil 2, the first coil 1 and the second coil 2 cancel the magnetic fluxes each other, so that an inductance occurs only by the leakage magnetic flux which occurs at the empty-space between the two coils. Consequently, the inductance becomes of a very small value. At that time, even if being compared with a case of forming an open magnetic path structure by using one coil, the generated magnetic fluxes are repressed, so that the inductance value thereof becomes very small.

As shown in FIG. 10 and FIG. 11, it is shown with respect to the variable inductors 10, 20 that the variable ranges of the inductances thereof become wide compared with that of the comparison sample. It should be noted in the first and the second exemplified embodiments mentioned above that the first coil 1 and the second coil 2 are produced by identical materials, by identical turn numbers and by identical winding methods, but they are not always the identical materials, the identical turn numbers or the identical winding methods.

Figure 12:
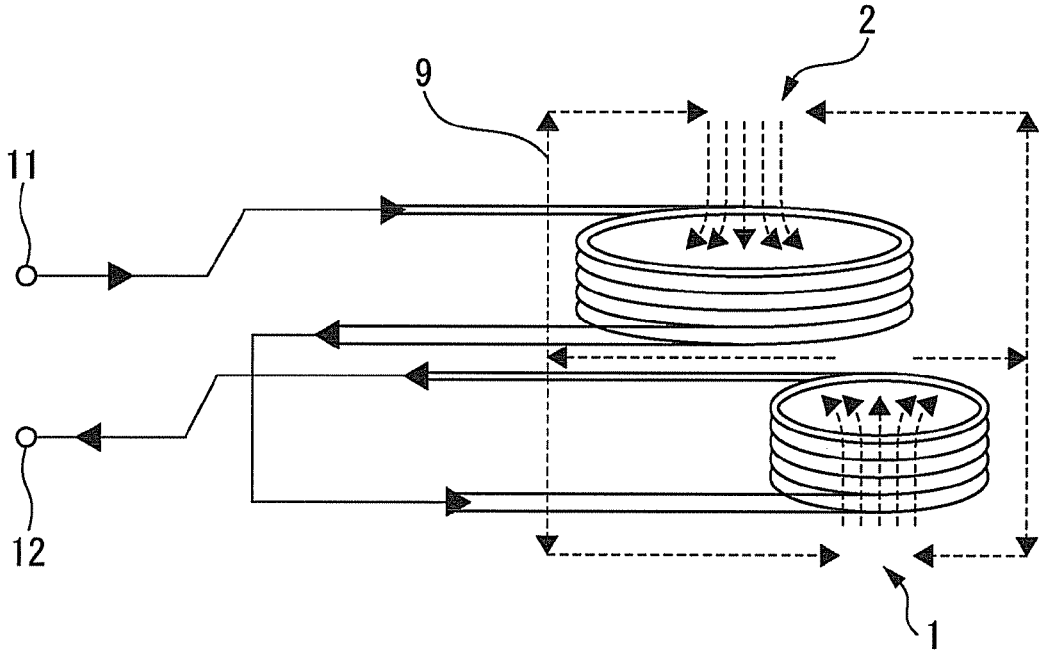
FIG. 12 is an explanatory diagram showing an example of an aspect of the magnetic flux in case of rendering winding axes and end-surface areas of first and second coils to be different.

FIG. 12 shows a situation of the magnetic fluxes in a case in which the winding axes and the end-surface areas of the first coil 1 and the second coil 2 are made to be different. It is assumed that the first coil 1 and the second coil 2 are connected in series (second connection method of the coils).

In this case, with respect to the variable inductor 20, for example, the winding axes of the first coil 1 and the second coil 2 do not coincide with each other perfectly or the end-surface areas of the first coil 1 and the second coil 2 are different. However, if it is a constitution in which the first coil 1 and the second coil 2 cancel the magnetic fluxes each other and reduce the magnetic fluxes, it is possible to obtain the operation and the effect relating to the present invention. Also, even if there is employed the variable inductor 20 which is made to have such a constitution, there is obtained an effect that the changeable range of the inductance becomes large compared with that of the comparison sample.

It should be noted in the variable inductor 10 that in a case in which the first coil 1 and the second coil 2 are connected in parallel (first connection method of the coils), even if the winding axes of the first coil 1 and the second coil 2 do not coincide with each other perfectly or the end-surface areas of the first coil 1 and the second coil 2 are different, it is possible, as mentioned above, to obtain the operation and the effect relating to the present invention.

Next, it will be explained with respect to a third exemplified embodiment of the present invention with reference to FIG. 13.

Also in this exemplified embodiment, it will be explained with respect to an example being applied to a variable inductor which is employed, for example, in small-sized electronic equipment or electronic circuit. In the following explanation, the same reference numerals are put on the portions corresponding to those in FIG. 1, which were already explained in the first exemplified embodiment and the detailed explanations thereof will be omitted.

FIGS. 13A, 13B, 13C and 13D show a constitution example of the variable inductor 30.

Figures 13A, 13B, 13C, 13D:
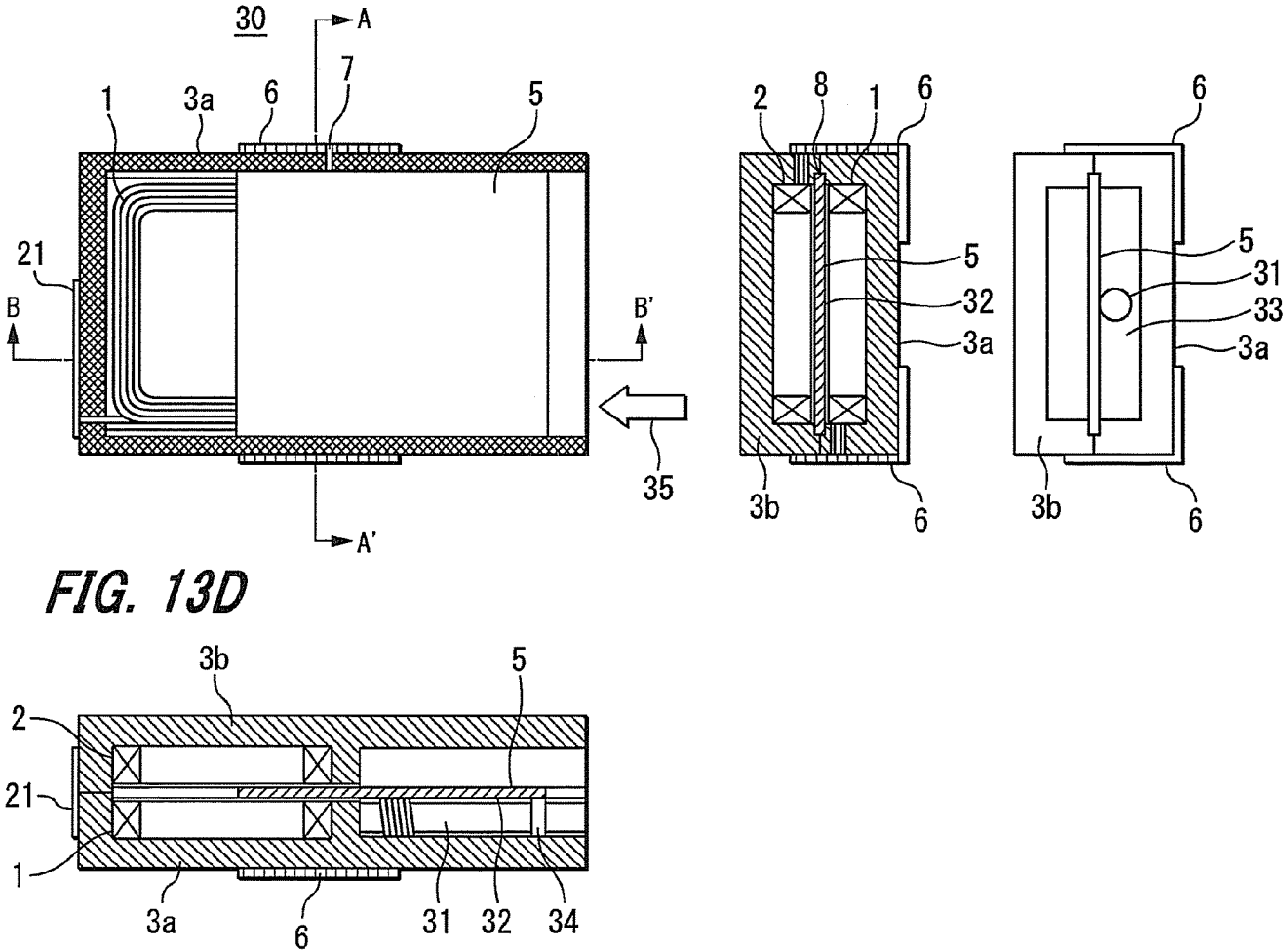
FIGS. 13A, 13B, 13C and 13D are constitution diagrams showing an example of a variable inductor in a third exemplified embodiment of the present invention.

FIG. 13A shows a constitution example of the variable inductor 30 in case of being plan-viewed.

FIG. 13B shows an example of a cross-section diagram along an A-A' line of the variable inductor 30 in FIG. 13A.

FIG. 13C shows a constitution example in case of viewing and confirming the variable inductor 30 in FIG. 13A from an arrow 35 direction.

FIG. 13D shows an example of a cross-section diagram along a B-B' line of the variable inductor 30 in FIG. 13A.

The constitution of the variable inductor 30 is approximately same as the constitution of the variable inductor 20 relating to the second exemplified embodiment mentioned above. However, with respect to the variable inductor 30, it is different in an aspect in which screw type adjusting means for moving the movable core 5 is included therein.

As shown in FIG. 13D, there are arranged and provided, at an empty-space of the upper and lower cores on the outside of the variable inductor 30, with an adjustment screw 31 which can adjust the position of the movable core 5 on the magnetic core 3*a*. For the adjustment screw 31, there is formed a first screw groove. On the other hand, on the surface of the movable core 5, which contacts with the adjustment screw 31, there is formed beforehand a screw groove 32 as a second screw groove which is fitted with the first screw groove. Also, at one end of the adjustment screw 31, there is arranged and provided a screw stopper 34 such that the adjustment screw 31 will not be detached from the variable inductor 30. Further, in order to keep the position of the adjustment screw 31, there is formed, around the adjustment screw 31, a screw guide 33 by means of a material of resin or the like. In addition, for the adjusting means for adjusting the position of the movable core 5, it is not limited by the screw type and it is also possible to use means of, for example, a motor or the like.

In this manner, by providing the adjusting means inside the variable inductor 30, the fine adjustment of the inductance becomes easy. Also, the movable core 5 is supported by the adjusting means, so that there is such an effect that it becomes difficult to be damaged against a vibration and a shock which are applied from the outside.

It should be noted in the variable inductors relating to the first to third exemplified embodiments mentioned above that it is allowed for the first coil 1 and the second coil 2 to be connected according to either one of the methods of series connection and parallel connection. Also, it is desirable for the first coil 1 and the second coil 2 to be formed by identical materials, by identical turn numbers and by identical winding methods, but it is allowed to employ a constitution in which at least either one within the winding axis and the end-surface area is different. In this case, the magnetic fluxes generated by the first coil 1 and the second coil 2 are a little bit different from each other, but if the magnetic fluxes are generated in directions for cancelling the mutual magnetic fluxes even for a very small amount, there is obtained a function as a variable inductor, so that it is possible to obtain a desired effect.

The invention claimed is:

1. A variable inductor comprising:

a first coil which emanates a first magnetic flux;

a second coil which emanates a second magnetic flux toward a direction cancelling the first magnetic flux;

a plate-shaped movable core for blocking the first and second magnetic fluxes emanated by said first coil and said second coil by being moved between said first coil and said second coil; and a magnetic core having a closed magnetic-path structure comprising a first magnetic core including said first coil and a second magnetic core including said second coil said first magnetic core having a first surface facing said second magnetic core, wherein a guide groove is provided at said first surface of said first magnetic core, said guide groove having an L-shaped cross section and movably supporting said plate-shaped movable core.

2. The variable inductor according to claim 1, wherein said first magnetic core includes a first center-core portion around which said first coil is wound, and said second magnetic core includes a second center-core portion around which said second coil is wound.

3. The variable inductor according to claim 1, wherein said first and second coils are arranged at the places at which the winding axis of said first coil and the winding axis of said second coil coincide each other, and said movable core moves toward the vertical direction with respect to the winding axis direction of said first and second coils.

4. The variable inductor according to claim 1, further comprising:

an adjusting unit for adjusting the position of said movable core with respect to said first and second coils.

5. The variable inductor according to claim 4, wherein said adjusting unit arranged for said magnetic core is formed with a first screw groove, and the surface of said movable core with which said first screw groove contacts is formed with a second screw groove fitted with said first screw groove.

6. The variable inductor according to claim 5, wherein said first coil and said second coil are connected in series or in parallel.

7. The variable inductor according to claim 5, wherein said first and second coils are different in at least either one within said winding axis and an end-surface area.

8. The variable inductor according to claim 6, wherein said first and second coils are different in at least either one within said winding axis and an end-surface area.

9. The variable inductor according to claim 6, wherein said first and second coils are formed by an identical material, by an identical turn number, and by an identical winding method.

10. The variable inductor according to claim 1, wherein the first and second coils are connected in parallel.

11. The variable inductor according to claim 10, wherein the first and second coils are different in at least either one of a winding axis and an end-surface area.

12. The variable inductor according to claim 10, wherein the first and second coils are formed by an identical material, by an identical turn number, and by an identical winding method.

* * * * *